US005222728A

United States Patent [19]

Takahashi

[11] Patent Number: 5,222,728

[45] Date of Patent: Jun. 29, 1993

[54] SHEET TRANSPORTING DEVICE HAVING VARIABLE LOOP SHEET ALIGNMENT

[75] Inventor: Kenichi Takahashi, Toyohashi, Japan

[73] Assignee: Minolta Camera Kabushiki Kaisha, Osaka, Japan

[21] Appl. No.: 779,028

[22] Filed: Oct. 18, 1991

[30] Foreign Application Priority Data

Oct. 22, 1990 [JP] Japan ..... 2-284796

[51] Int. Cl.[5] ..... B65H 9/00

[52] U.S. Cl. ..... 271/242; 271/265

[58] Field of Search ..... 271/242, 258, 265, 266, 271/256

[56] References Cited

U.S. PATENT DOCUMENTS 3,966,198 6/1976 Komada et al. ..... 271/265
5,022,642 6/1991 Hasegawa et al. ..... 271/242

FOREIGN PATENT DOCUMENTS 346220 12/1989 European Pat. Off. ..... 271/242
352813 1/1990 European Pat. Off. ..... 271/265
217451 9/1986 Japan ..... 271/242
127953 5/1988 Japan ..... 271/265
226653 9/1989 Japan ..... 271/242
13535 1/1990 Japan ..... 271/265
2-204239 8/1990 Japan .

*Primary Examiner*—Robert P. Olszewski
*Assistant Examiner*—Steven M. Reiss
*Attorney, Agent, or Firm*—Willian Brinks Olds Hofer Gilson & Lione

[57] ABSTRACT

A sheet transporting device including a first and a second transporting rollers having different starting/stopping characteristics and capable of retransporting a sheet after the sheet is temporarily held between the first and the second transporting rollers. The sheet transporting device detects an amount of loop in a sheet which is produced between the first and the second transporting rollers and controls timing by which the second transporting rollers are started so as to delay the start until after the first transporting rollers are started in accordance with the detected amount of the loop.

7 Claims, 8 Drawing Sheets

SHEET TRANSPORTING DEVICE HAVING VARIABLE LOOP SHEET ALIGNMENT

BACKGROUND OF THE INVENTION

1. Field of the Invention

The present invention relates to a sheet transporting device for use in sheet handling apparatus such as copying machines, laser printers and the like. More specifically, the present invention relates to a sheet transporting device capable of delivering sheets between a first transporting means and a second transporting means having different stopping characteristics and starting characteristics, and capable of re-transporting a sheet after the sheet is temporarily held in a state bilaterally straddling the first and second transporting means.

2. Description of the Related Art

The aforesaid type of sheet transporting device is used, for example, when a copying machine with a document feeder disposed on a base unit forms images on a sheet transported from the base unit document feeder. More specifically, in the main unit of the copying machine, the transported transfer sheet is temporarily stopped at a timing roller disposed immediately in front of the transfer portion and then re-transported after a predetermined interval so as to prevent skewing and align the leading edges of the sheet and the image formed on the surface of the photosensitive drum. During the aforementioned temporary stopping time, the sheet often bilaterally straddles the base unit side and the copying machine side depending on the size of the sheet. Thus, the sheet transporting mechanism on the base unit side and the sheet transporting mechanism on the copying machine side, which feeds the transfer sheet received from the base unit side to the timing roller, are temporarily stopped for a predetermined interval after the paper sheet has reached the timing roller and then are re-actuated with a predetermined timing.

If the sheet transporting mechanism within the base unit is connected to and controlled by the various mechanisms within the main unit of the copying machine, these mechanisms and controls become quite complex and expensive, and further make it quite inconvenient to move the copying machine and the like. Therefore, the aforesaid construction and controls may be simplified by operating the sheet transporting mechanism in base unit by means of a motor independent of the copying machine unit, thereby also allowing convenience in moving the copying machine and the like. In such a case, the timing roller in the copying machine unit and the sheet transporting mechanism disposed anteriorly thereto jointly use the main motor provided in the copying machine unit, and are mutually connected via the main motor and a clutch so as to be respectively actuatable as required. The base unit sheet transporting mechanism, however, is actuated and stopped by switching on and off an independent motor without providing a discoupling structure between said sheet transporting unit and the independent motor of the base unit, thereby simplifying the construction and controls.

The differences between the timing roller and the anterior sheet transporting mechanism on the copying machine side and the sheet transporting mechanism and the drive mechanism on the base unit side produces differences in drive torque and inertia. These differences in torque and inertia likewise provide different stopping and starting characteristics.

Therefore, when the transfer sheet is re-transported after being temporarily stopped as previously described, a loop is produced in the transfer sheet between the sheet transporting mechanism of the copying machine and the sheet transporting mechanism of the base unit. This loop is caused by differences in the stopping characteristics of the temporary stopping interval.

The sheet transporting mechanism in the base unit and the sheet transporting mechanism in the copying machine are both driven simultaneously when the transfer sheet is re-transported. Therefore, when the transfer sheet is re-transported while in the previously described looped condition, wrinkling and jamming of the sheet may occur.

The amount of looping of the sheet will differ depending on the material and thickness and the like of the sheet, and depending on differences in the transporting characteristics at times. Accordingly, this looping condition cannot be corrected via a predetermined correction value.

SUMMARY OF THE INVENTION

A main object of the present invention is to prevent wrinkling and jamming of the transfer sheet by eliminating the previously described loop formed in the transfer sheet.

A further object of the present invention is to control the timing by which the sheet transporting mechanism is driven in accordance with the differences in the amount of loop produced in the transfer sheet.

These and other objects of the present invention are achieved by providing a sheet transporting device comprising a first sheet transporting means driven by a first drive means, a second sheet transporting means driven by a second drive means different from the first drive means and which transports the sheet fed by the first sheet transporting means, a detecting means for detecting the amount of loop in the sheet produced between both transporting means during the stopping interval of the first and second transporting means, and a control means for controlling timing for starting said first and second sheet transporting means in accordance with the amount of loop detected by the detecting means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
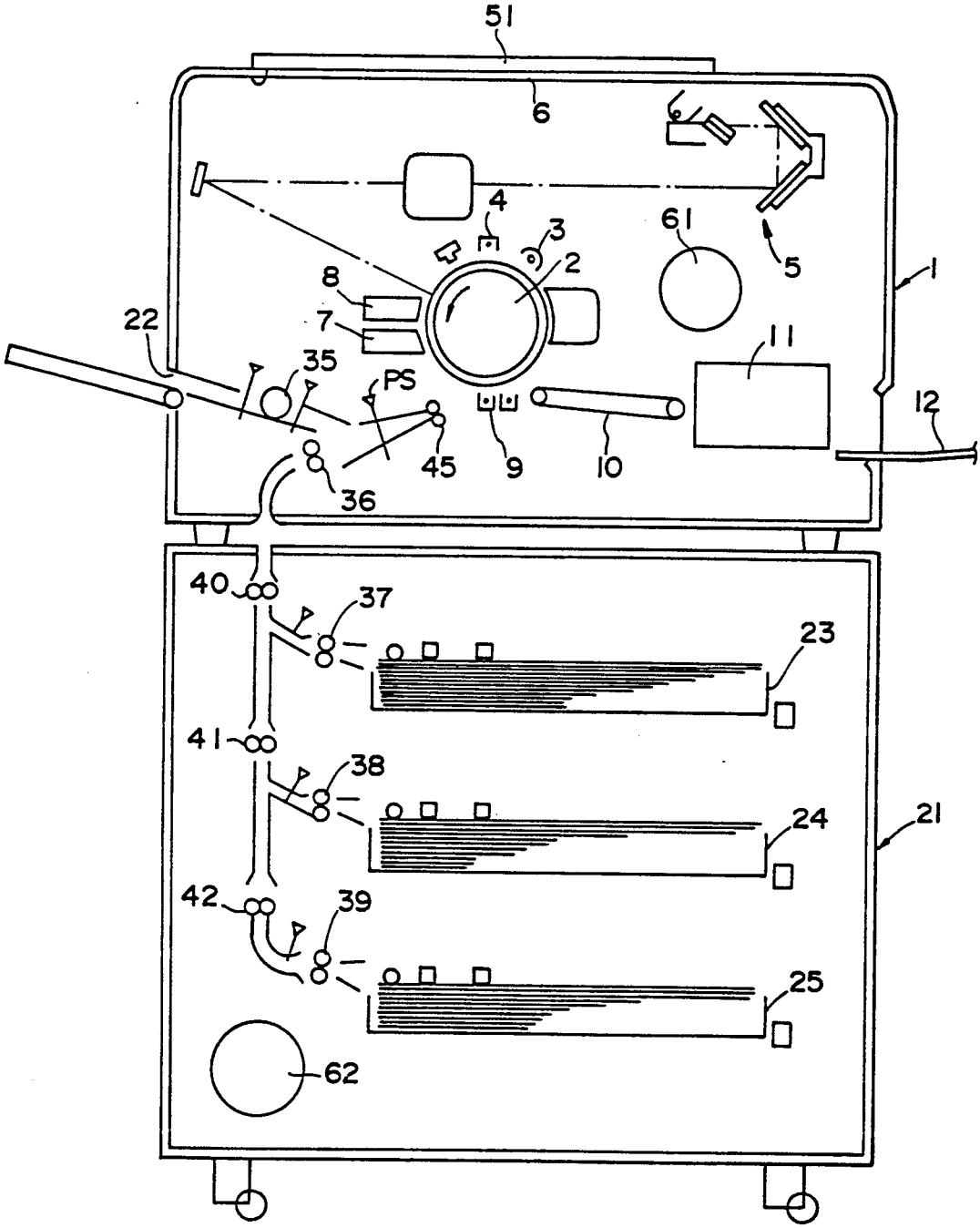
FIG. 1 is an illustration showing the general construction of a copying machine using an embodiment of the invention.

FIG. 1 shows the overall construction in the case wherein an embodiment of the invention is adapted to a copying machine. The copying machine 1 is disposed on a paper supplying unit 21, and a document cover 51 is provided on the top of the copying machine 1. A photosensitive drum 2 is provided near the center within the copying machine 1. The photosensitive drum 2 is rotatably driven in the arrow direction, and the surface of the drum 2 is uniformly charged in the image forming region by means of an eraser lamp 3 and a charger 4. The image of the original document disposed on the glass platen 6 at the top of the copying machine 1 is exposed on the uniformly charged surface of the photosensitive drum 2 via the exposure optical unit 5, so that an electrostatic latent image corresponding to the original document image is formed on the surface of the drum. The electrostatic latent image formed on the surface of the photosensitive drum 2 is developed by either of the developing devices 7 or 8 so as to form a developed image. The developed image formed on the surface of the photosensitive drum 2 is then transported to the transfer portion adjacent to the transfer charger 9, whereupon the developed image is transferred onto a transfer sheet by the transfer charger 9.

A transfer sheet fed manually from the manual feeder 22 provided on the copying machine 1, or a transfer sheet fed from any of the paper cassettes 23, 24 or 25 loaded in the paper supplying unit 21 is transported to the transfer portion and receives the transfer image. After the image is transferred to the sheet, the transfer sheet is separated from the photosensitive drum 2 and suctioned to the transport belt 10 for transport to the fixing device 11 which fixes the transfer image on the sheet. After the image is fixed on the sheet, the transfer sheet is discharged to the discharge tray 12 outside the copying machine 1.

The transfer sheet fed from either the manual feeder 22 or paper cassettes 23, 24 or 25 is transported to the transfer portion by the transport rollers 35 through 42, and delivered to the stationary timing roller 45, which is in a standby state, so that by regulating the leading edge of the sheet skewing may be prevented. The timing for feeding the sheet to the transfer portion is regulated by timing the start of the actuation of the timing roller 45. The leading edge of the developed image formed on the surface of the photosensitive drum 2 and the leading edge of the transfer sheet are aligned so as to coincide by means of the aforesaid timing regulation.

The timing roller 45 and the transport roller 36 in the copying machine 1 are driven by the main motor 61 which is the drive unit for the copying machine 1 via a clutch not shown in the drawings. The transport rollers 37 through 42 in the paper supplying unit 21 are directly driven by the motor 62 which is the drive unit for the paper supplying unit 21 via a gear or belt combination not shown in the drawings.

As described above, the aforesaid drive transmission mechanisms are different. Due to the dissimilarities of the drive resistance and inertia between the mechanisms caused by said difference, the stopping characteristics and starting characteristics of the timing roller 45 and transport roller 36 and transport rollers 37 through 42 are also different.

Figure 3:
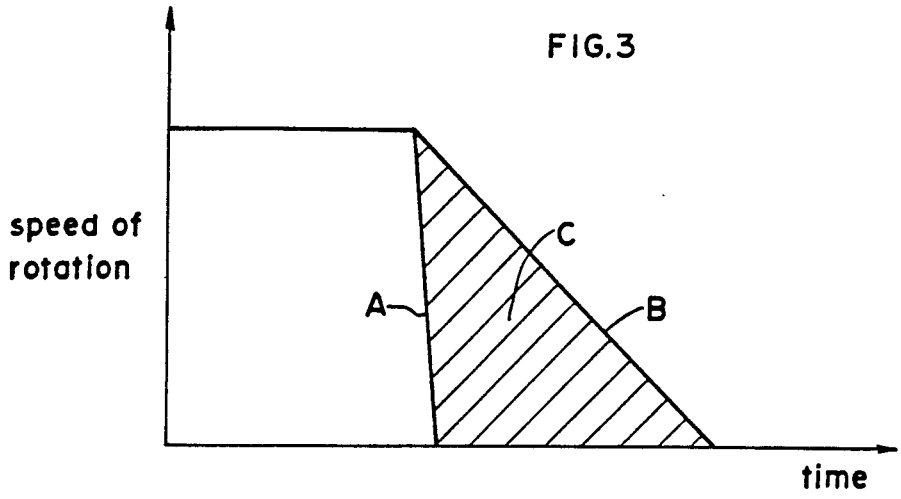
FIG. 3 is a graph showing the differences in the stopping characteristics of the sheet transporting means of the base unit and the copying machine.

FIG. 3 shows the stopping characteristics A and B of the transport roller 36 and the transport rollers 37 through 42.

The stopping characteristics A indicate the characteristics of the transport roller 36 receiving the drive transmission through the clutch. The transport roller 40 provided within the paper supplying unit 21 has stopping characteristics similar to those indicated by characteristics B because its connection with the motor is not broken during the stopping procedure.

Figure 2:
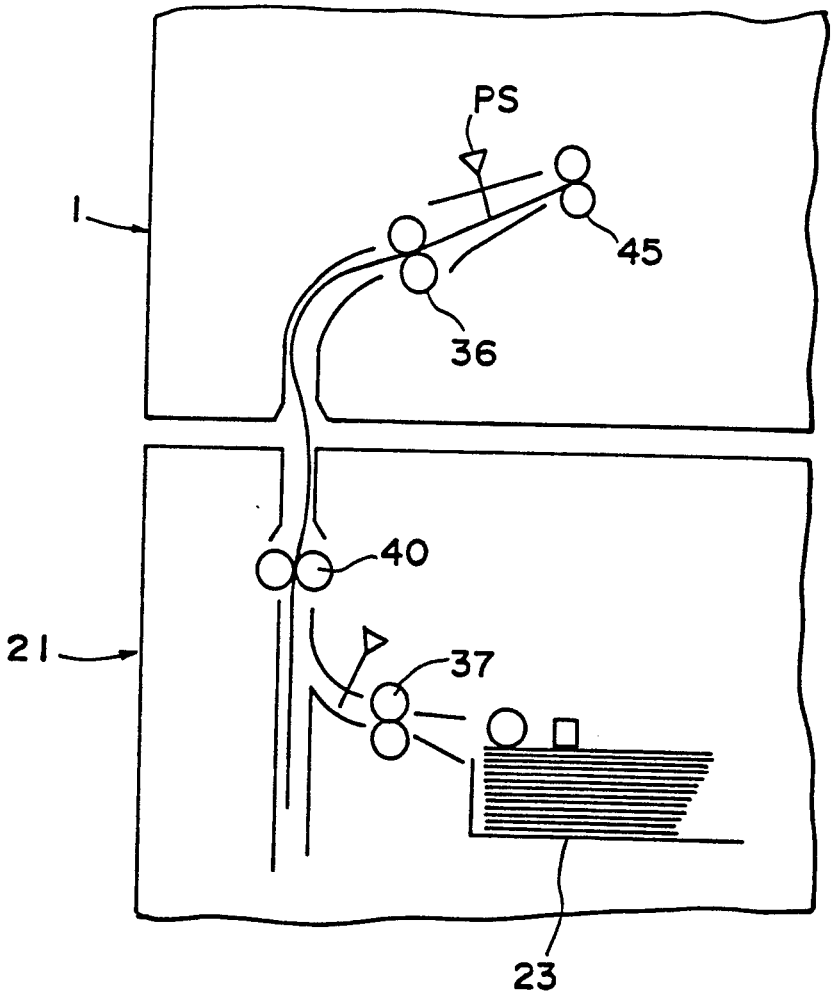
FIG. 2 is an enlarged view showing the sheet receiving portion disposed between each sheet transporting means of the base unit and the copying machine.
Figure 4:
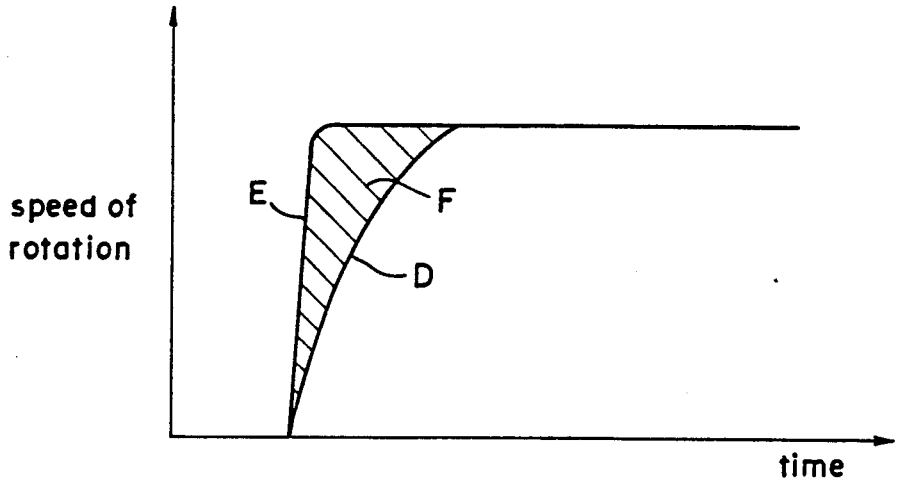
FIG. 4 is a graph showing the differences in the moving characteristics of the individual sheet transporting means of the base unit and the copying machine.

During stopping, a loop corresponding to the shaded portion C is produced between the transport roller 36 and the transport roller 40, as shown in FIG. 2. FIG. 4 shows the starting characteristics D and E of the transport rollers 37 through 42, the timing roller 45 and the transport roller 36. If, for example, the timing roller 45 and the transport roller 36 are restarted at the same time the transport rollers 37 through 42 are started, the amount of loop elimination is indicated by the shaded portion F, and the amount of the remaining loop corresponds to C-F. When this remaining loop becomes excessively large, the transfer sheet may jam.

Figure 5:
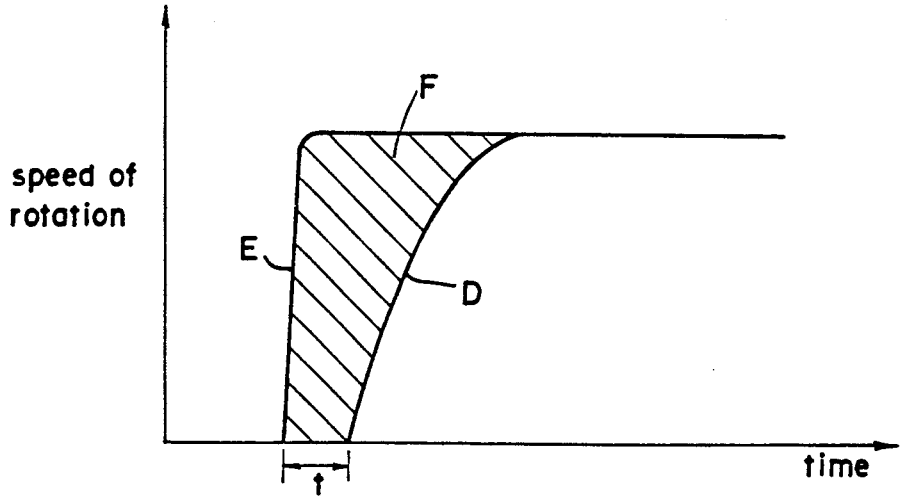
FIG. 5 is a graph showing the regulation state of the timing for starting the individual sheet transporting means of the base unit and the copying machine.

As shown in FIG. 5, the start of the transport rollers 37 through 42 is delayed an interval t from the start of the timing roller 45 and the transport roller 36. The interval t is set such that C=F at this time.

Therefore, by considering the aforesaid differences in the stopping characteristics and starting characteristics of the transport roller 36 and the transport rollers 37 through 42, it is possible to virtually eliminate the loop produced in the transfer sheet by the differences in the stopping characteristics when restarting the transport roller 36 and the transport rollers 37 through 42.

The amount of loop produced in the transfer sheet is usually not always constant inasmuch as the amount of loop is dependent upon the occasional variations produced in the transporting conditions by variations in the transfer sheet material, thickness and the like. The amount of loop actually produced in the transfer sheet depends on the aforesaid occasional differences in transport conditions. In the present embodiment, the actual amount of the loop occasionally produced in the transfer sheet when the transport roller 36 and the transport rollers 37 through 42 are restarted is detected by a detecting means. Thus, the occasional variations in the transport conditions can be compensated in accordance with the actual amount of looping detected by modifying the timing for starting the rollers in view of the differences in the stopping characteristics and starting characteristics of the timing roller 45 and the transport roller 36 and the transport rollers 37 through 42.

Figure 6:
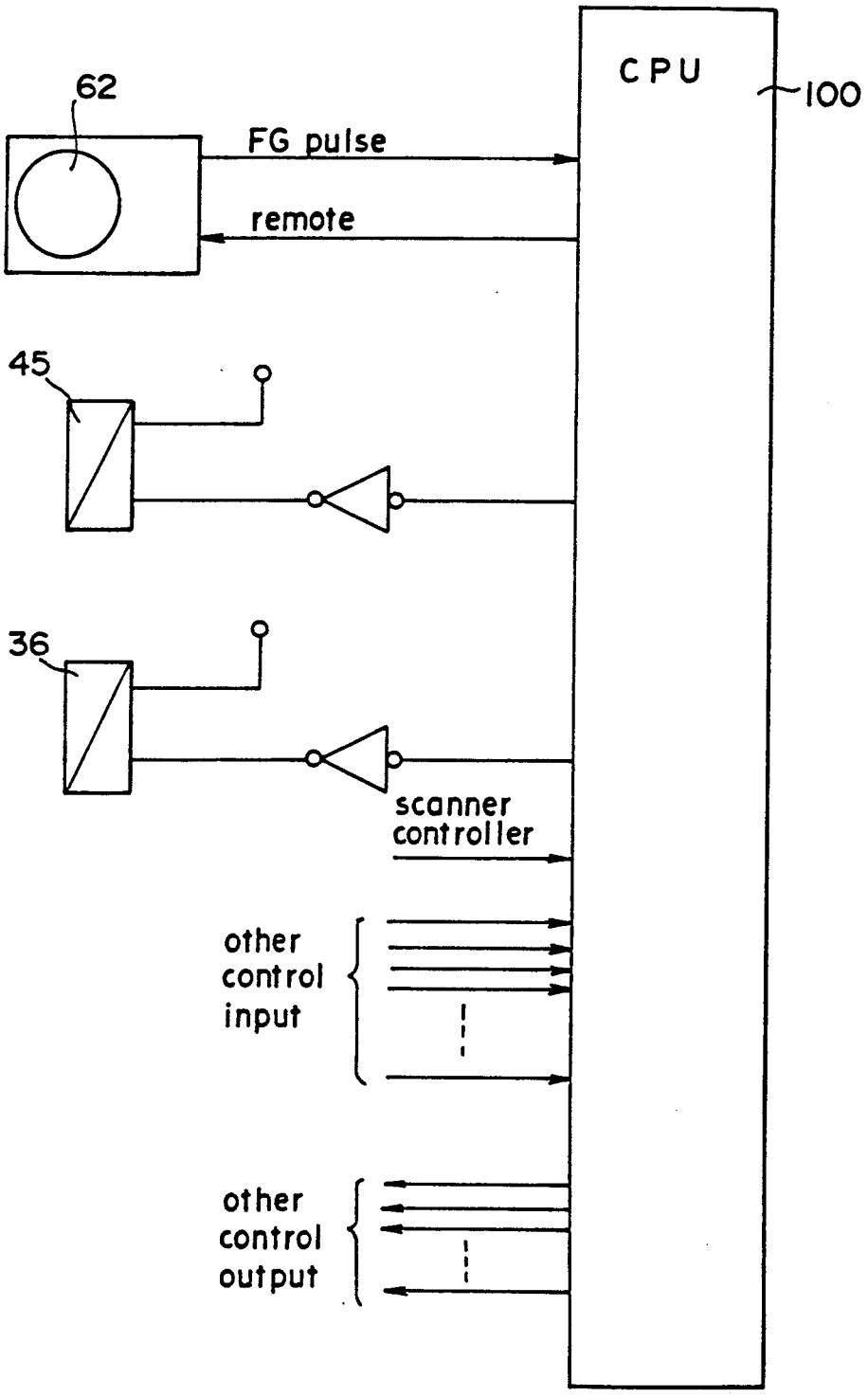
FIG. 6 is a block diagram of the control circuit.

The previously mentioned control is accomplished by means of the central processing unit (CPU) 100 which controls the operation of the copying machine, as shown in FIG. 6. In order to achieve the aforesaid control, the CPU 100 is provided a remote signal line for the drive motor 62 of the paper supplying unit 21. The CPU 100 is also connected to a signal line from the pulse generator attached to the motor 62 and signal lines for controlling the on/off switching of the clutches for the timing roller 45 and the transport roller 36. The pulse generator FG of the motor 62 generates pulses in accordance with the rotation of the motor. When the drive forces transmitted to the transport roller 36 and the transport rollers 37 through 42 are discontinued, the transport roller 36 stops almost immediately, and the transport rollers 37 through 42 stop shortly thereafter in concert with the motor 62. After the aforesaid drive force transmission is discontinued, the rotation of the motor 62 is stopped with a delay corresponding to the stopping characteristics of the transport rollers 37 through 42 and the occasional variations in transport conditions depending on the transfer sheet material, thickness and the like. Accordingly, the number of pulses generated by the pulse generator FG in accordance with the rotation of the motor 62 during this interval is counted by the CPU 100, so as to detect the amount of loop produced in the transfer sheet.

The aforesaid control is described in detail hereinafter with reference to the flow charts in FIGS. 7 through 10.

Figure 7:
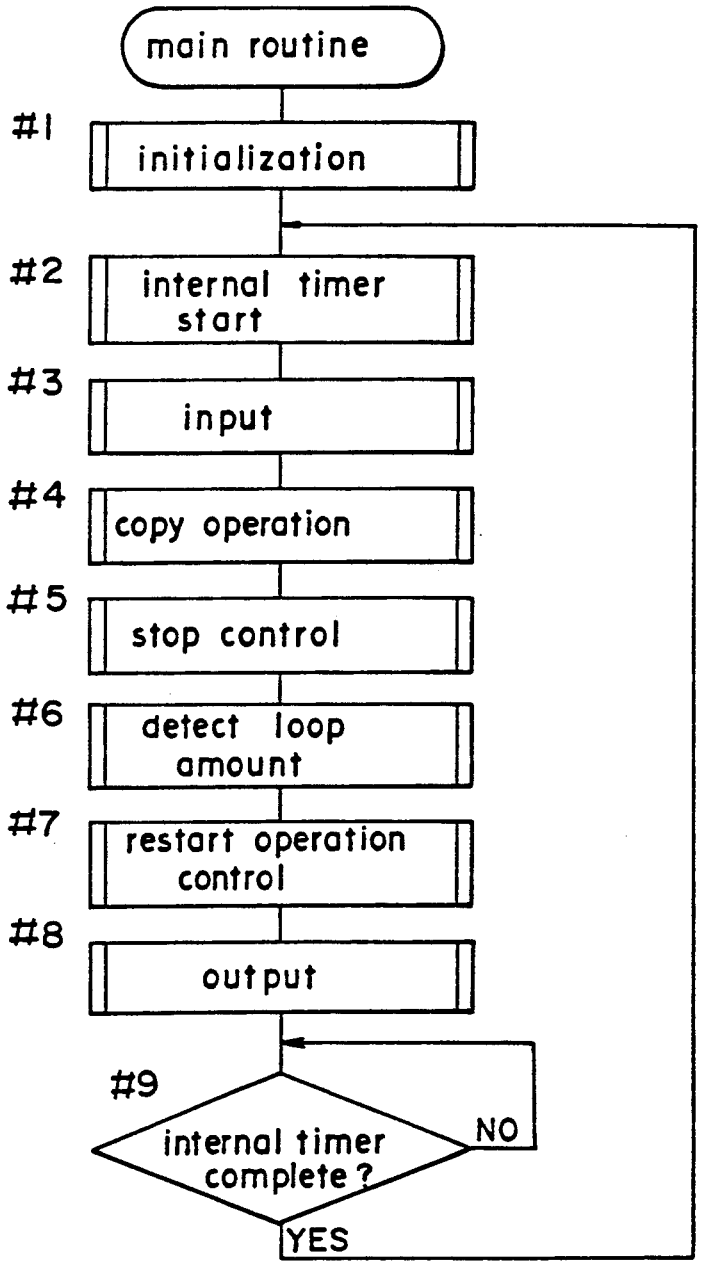
FIG. 7 is a flow chart showing the main routine for overall control of the copying machine.

FIG. 7 shows the main routine for overall control of the copying machine. When the power is switched ON, the all devices are initialized in step #1 to clear the internal random access memory (RAM) in the CPU 100 and set the standard mode. In step #2, the internal timer in the CPU 100 is started. This timer regulates the time period allowed for a single routine required for the controls described below. In step #3, input from the operation portion, switches, sensors and the like are processed. Continuous operation from the copy operation from start to completion is executed in step #4. Then, in step #5, the stop control process is executed for the transport roller 36 and the transport rollers 37 through 42. The amount of loop produced in the transfer sheet is detected in step #6. Then, in step #7, the restart operation process is executed for the timing roller 45, the transport roller 36 and the transport rollers 37 through 42. The control signals, display signals and the like are output in step #8. In step #9, the completion of the internal timer is awaited; when the timer is completed, the program returns to step #2 and the previously described operations are repeated.

Figure 8:
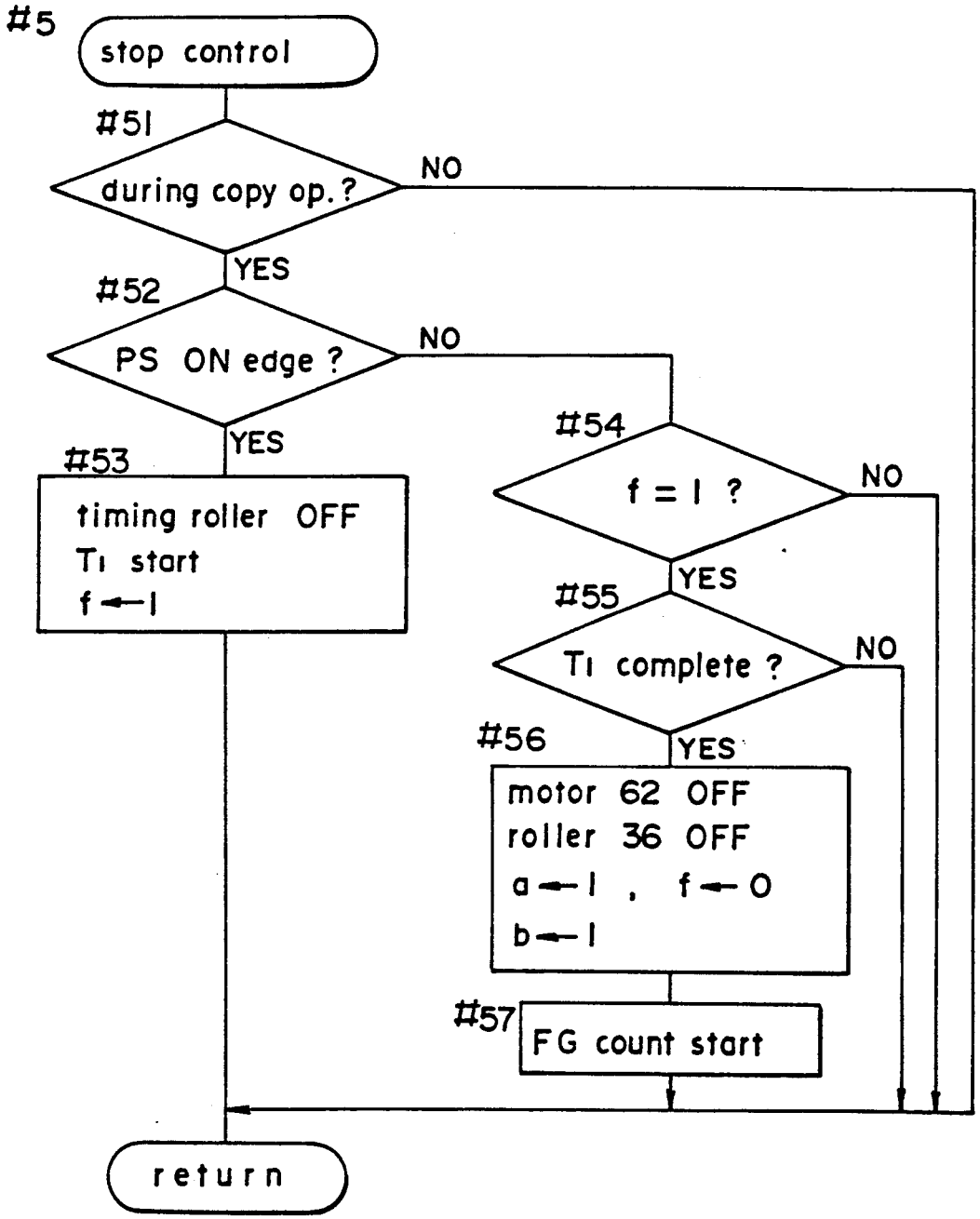
FIG. 8 is a flow chart showing the stopping control subroutine.

FIG. 8 is a flow chart showing the stop control subroutine of step #5 in FIG. 7. In step #51 a check is made to determine whether or not a copy operation is in progress. If a copy is underway, and the paper sensor PS (FIGS. 1 and 2) is on edge in step #52, the timing roller 45 is stopped, the timer $T_1$ is started, and the flag f is set at [1] (step #53). The timer $T_1$ is set for a time period which allows a predetermined amount of loop to be produced in the transfer sheet that has passed the paper sensor PS and reached the timing roller 45, such that said loop is produced between the timing roller 45 and the transport roller 36. When the on edge state of the paper sensor PS is not detected in step #52, the completion of the timer $T_1$ is awaited in step #54 upon condition that the flag f is set at [1]. Then, the clutch of the transport roller 36 is switched OFF in step #55, and in step #56 the motor 62 of the paper supply unit 21 is switched OFF, the flags a and b are set at [1], and the flag f is set at [0]. At this time, the transfer sheet is delivered to the timing roller 45, the timing is adjusted, and the standby state is set to await the restart. Subsequently, the pulses produced by the pulse generator are counted in step #57.

Figure 9:
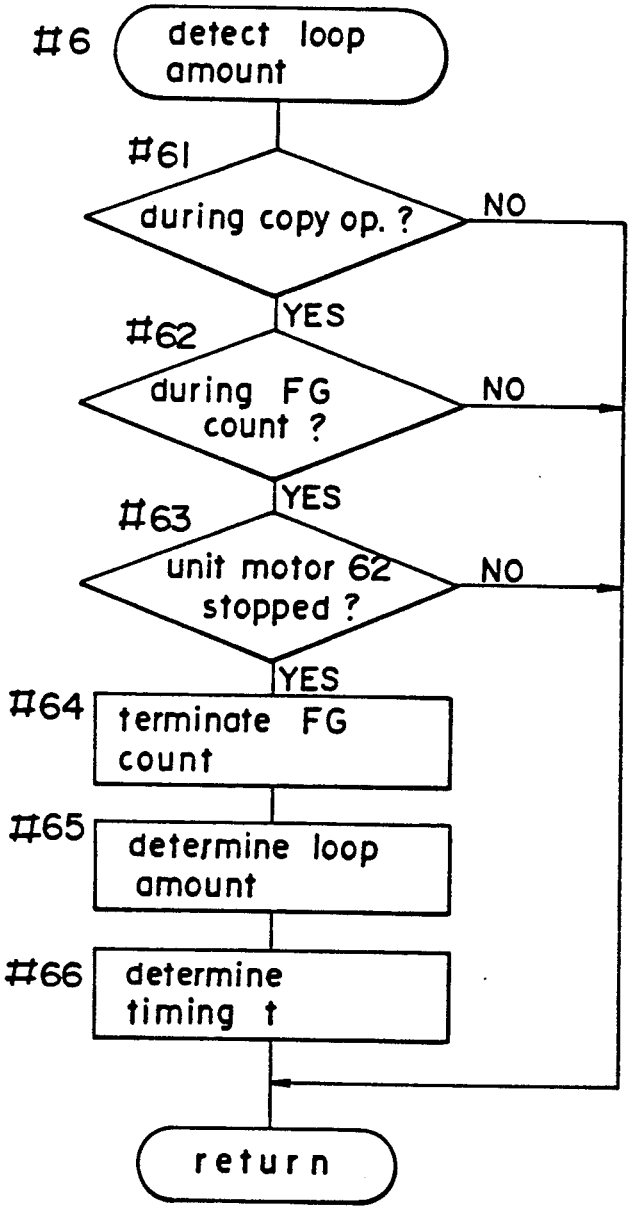
FIG. 9 is a flow chart showing the loop detection subroutine.

FIG. 9 is a flow chart showing the loop detection subroutine of step #6 in FIG. 7. A check is made in step #61 to determine whether or not a copy operation is in progress. If a copy is underway and the pulse counting operation is in progress in step #62, a check is then made in step #63 to determine whether or not the paper supplying unit motor 62 is stopped. If the motor 62 is stopped, the pulse count is terminated in step #64, and the amount of looping is determined by the counter value in step #65. Then, in step #66, the restart timing t for the transport rollers 37 through 42 is determined in accordance with the aforesaid determined magnitude of the loop as shown in the loop level classifications of Table 1. Therefore, the transport sheet can be transported properly whatever the magnitude of the loop. In the loop level classifications of the present embodiment, the time t is set so that the lower limit of loop magnitude is 0, and the upper limit allows the transfer sheet to be transported unhindered with a slight loop intact.

TABLE 1

| | up to | less than | | |
|---|---|---|---|---|
| Loop C (mm) | 4~6 | 6~8 | 8~10 | — |
| t (ms) | 15 | 30 | 45 | — |
| — | 18~20 | 20~22 | 22~24 | — |
| — | 120 | 135 | 150 | — |

When the amount of loop C is in the range of $2(n+1)(mm) \leqq \times (mm) < 2(n+2)(mm)$ (n is an integral number), t is prescribed 15n (ms). Since the range of loop amount and the value of t are determined by the speed of sheet transportation, staring characteristics and the like, the setting about each value is not limited to the above-mentioned one.

Figure 10:
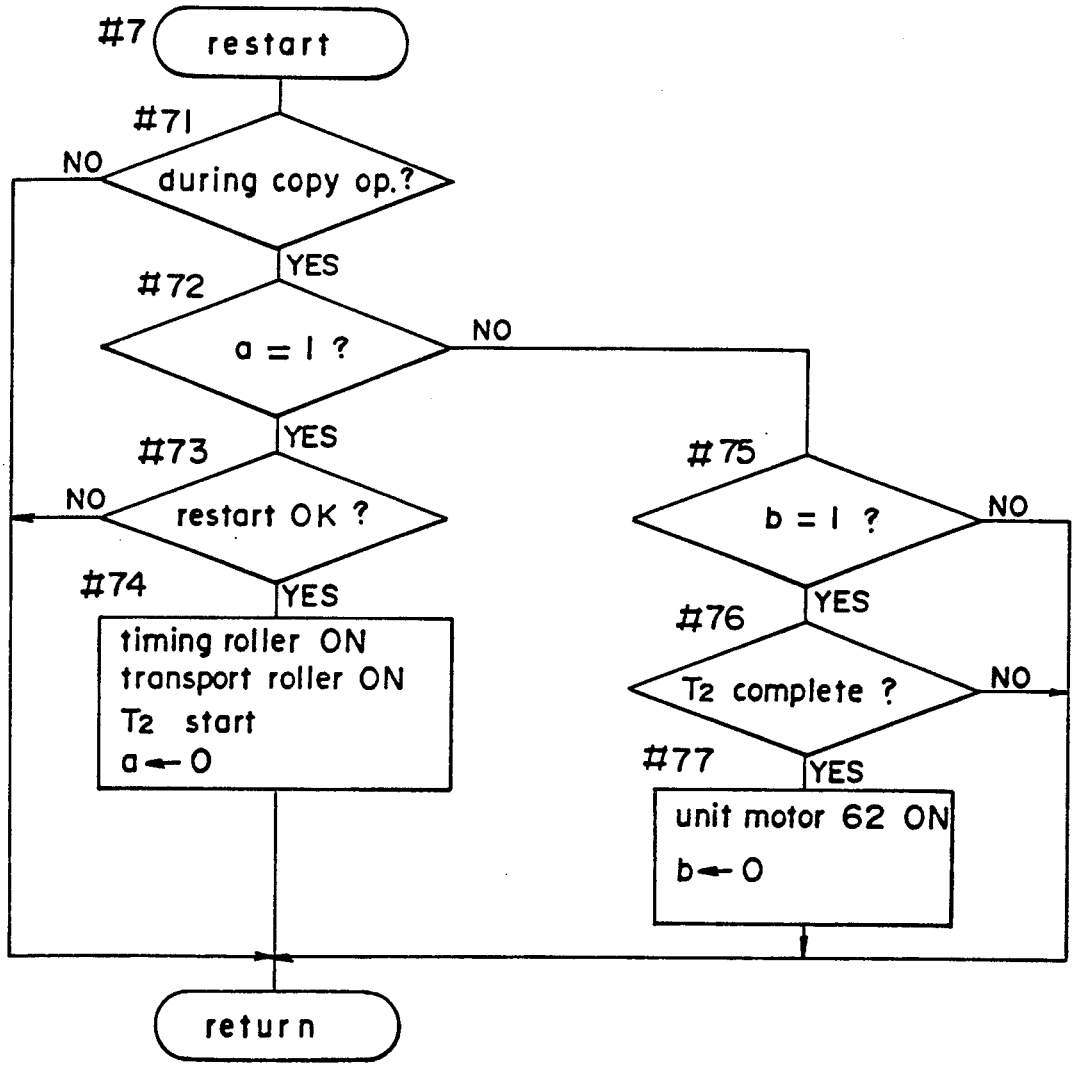
FIG. 10 is a flow chart showing the restart process subroutine.

FIG. 10 is a flow chart of the restart control subroutine of step #7 in FIG. 7. A check is made in step #71 to determine whether or not a copy operation is in progress. If a copy is underway and the flag a is found to be set at [1] in step #72, a determination is made as to whether or not the restart is possible in step #73. This determination is made by checking for the presence of an input signal from the scanner controller. If such a signal has been input, the restart is possible. Then, in step #74, the clutches of the timing roller 45 and the transport roller 36 are switched ON, and the timing roller 45 and the transport roller 36 are started first. Then, a timer $T_2$ is set at the aforesaid time interval t and started so as to derive the restart timing for the transport rollers 37 through 42 from the restart timing of the timing roller 45 and the transport roller 36. The flag a is set at [0].

If the flag a is set at [1] in step #72, the routine progresses to step #75 where a check is made to determine whether or not the flag b is set at [1]. If the flag b is set at [1], the completion of the timer $T_2$ is awaited in step #76, whereupon the paper supplying unit motor 62 is switched ON in step #77. The transport rollers 37 through 42 can thus be restarted at the instant at which the loop in the transfer sheet has been eliminated. Then, the flag b is reset at [0].

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet transporting device comprising:

a first sheet transporting means driven by a first drive means;

a second sheet transporting means driven by a second drive means different from the first drive means and transporting the sheet fed by said first sheet transporting means;

a detecting means for detecting an amount of loop in the sheet produced between both transporting means during a stopping interval of said first and second transporting means; and a control means for varying timing for starting said first sheet transporting means in accordance with the amount of loop detected by said detecting means.

2. The sheet transporting device as claimed in claim 1, wherein the starting/stopping characteristics of said first and second sheet transporting means are different from each other.

3. The sheet transporting device as claimed in claim 1, wherein said detecting means includes a pulse generating means for generating pulses corresponding to the amount of loop, and a counter for counting pulses generated by said pulse generating means.

4. The sheet transporting device as claimed in claim 1, wherein the amount of loop detected by said detecting means is classified into predetermined levels, and wherein said control means varies said timing by an amount corresponding to each of said predetermined levels.

5. A sheet transporting device comprising:

a first transporting means for transporting sheets;

a second transporting means for transporting sheets, which has different starting and stopping characteristics from those of said first transporting means, wherein said first and second transporting means are capable of stopping a sheet temporarily therebetween by stopping their operation and thereafter transporting the sheet again;

a detecting means for detecting an amount of loop in the sheet produced between both transporting means when said sheet is stopped; and a control means for controlling timing by which the second transporting means is started so as to delay said start until after said first transporting means is started in accordance with the amount of loop detected by said detecting means.

6. The sheet transportation device as claimed in claim 5, wherein said detecting means includes a pulse generating means for generating pulses corresponding to the amount of loop, and a counter for counting pulses generated by said pulse generating means.

7. The sheet transporting device as claimed in claim 5, wherein the amount of loop detected by said detecting means is classified into predetermined levels, and wherein said control means controls said timing by an amount corresponding to each of said predetermined levels.

* * * * *

UNITED STATES PATENT AND TRADEMARK OFFICE

CERTIFICATE OF CORRECTION

PATENT NO. : 5,222,728
DATED : June 29, 1993
INVENTOR(S) : Kenichi Takahashi

It is certified that error appears in the above-indentified patent and that said Letters Patent is hereby corrected as shown below:

In Col. 8, line 20 (Claim 6, line 1), change "transportation" to --transporting--.

Signed and Sealed this
Eighth Day of March, 1994

Bruce Lehman

*Attest:*

BRUCE LEHMAN

*Attesting Officer*

*Commissioner of Patents and Trademarks*